United States Patent [19]

O'Reilly et al.

[11] 4,012,075

[45] Mar. 15, 1977

[54] DEVICE FOR ADJUSTING THE LEGS OF ADJUSTABLE WHEELCHAIRS

[76] Inventors: Bernard M. O'Reilly, 470 Earle St.; James F. Best, 105 W. Suffolk Ave., both of Central Islip, N.Y. 11722

[22] Filed: Dec. 2, 1975

[21] Appl. No.: 636,991

[52] U.S. Cl. ..... 297/434; 81/3 R; 254/131; 297/DIG. 4

[51] Int. Cl.[2] ..... A47C 7/50

[58] Field of Search ..... 297/429, 433, 434, DIG. 4; 254/120, 131; 29/278; 81/3 R

[56] References Cited

UNITED STATES PATENTS

| | | | |
|---|---|---|---|
| 1,030,660 | 6/1912 | Hunt | 254/131 |
| 3,000,632 | 9/1961 | Fuchs | 297/433 X |
| 3,376,067 | 4/1968 | Kernes | 297/433 X |

*Primary Examiner*—James C. Mitchell

[57] ABSTRACT

A generally inverted L-shaped device for elevating or lowering the legs of a wheelchair which is provided with adjustable legs. The device has a first elongated member having a free end and a second elongated member having a free end formed angularly with the first elongated member. A positioning bracket is secured to the first elongated member for releasable engagement to either side of the wheelchair as a fulcrum and a cross member is transversely secured at the free end of the first elongated member for supporting either leg of the wheelchair thereon. A pair of generally vertical, upwardly extending arms at the ends of the cross member serve to prevent the legs from sliding off when the device is used to raise or lower each leg to any desired convenient height.

8 Claims, 5 Drawing Figures

1
3
5
7
9
11
12
13
15
17
19
21
23
25
27
29
31
33
35
37
39
14
5

DEVICE FOR ADJUSTING THE LEGS OF ADJUSTABLE WHEELCHAIRS

BACKGROUND OF THE INVENTION

Field of Invention

This invention relates to wheelchairs which are equipped with adjustable legs and is particularly related to a device for use in conjunction with such wheelchairs in order to elevate or lower the legs to any desired position.

The Prior Art

Wheelchairs of the type provided with adjustable legs have proven to be of great aid to invalids during their period of confinement. So far as it is known, however, commonly available wheelchairs are usually equipped with leg-adjusting mechanisms or assemblies which are integral parts of the wheelchair and which are difficult or inconvenient to operate. Moreover, the provision of such mechanisms or assemblies as integral parts of such wheelchairs complicates the manufacture and increases the cost of the wheelchairs.

SUMMARY OF THE INVENTION

In accordance with this invention a generally inverted L-shaped device is provided which comprises a first elongated member having a free end and a second elongated member having a free end formed angularly with the first elongated member. A positioning bracket is secured to the first elongated member for engagement to either side of the wheelchair and a generally flat cross member is transversely secured to the free end of the first elongated member for supporting either leg of the wheelchair. A pair of generally, vertical, upwardly extending arms which may be formed integrally with said cross member at the ends thereof serve to prevent the legs from sliding off during the use of the device for elevating or lowering each leg to any desired convenient height.

Other details of this invention will now be described with particular reference to the accompanying drawings.

DESCRIPTION OF THE DRAWINGS

Like numerals in the drawings designate like parts.

DETAILED DESCRIPTION OF THE INVENTION

Figures 1, 2, 3, 4, 5:
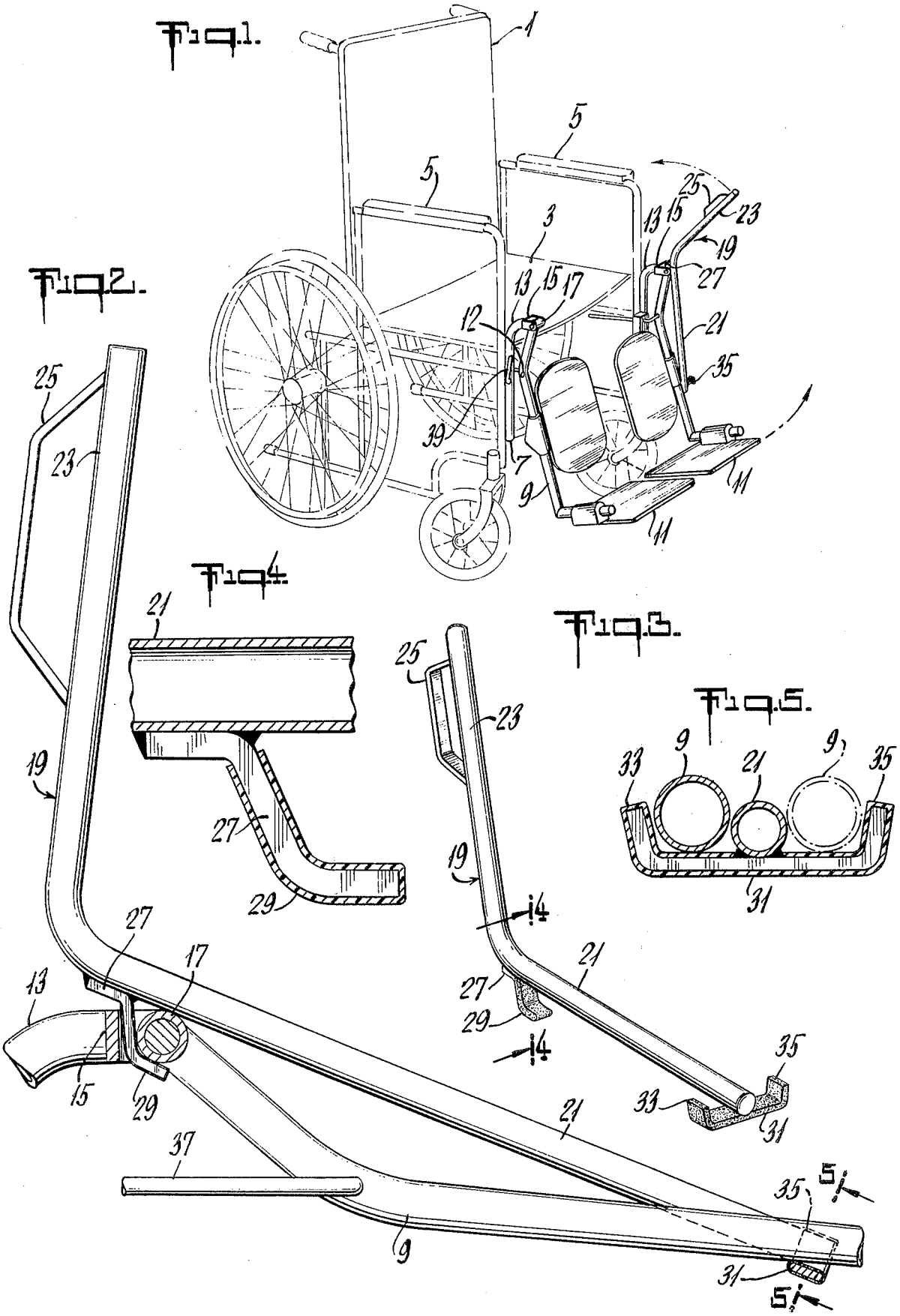
FIG. 1 is a perspective view of a wheelchair of the type equipped with legs and showing the device of this invention mounted adjacent the left leg of the wheelchair.
FIG. 2 is a side view of the device of this invention illustrating its position when it is used to raise the leg of the wheelchair.
FIG. 3 is a perspective view of the device shown in FIG. 2.
FIG. 4 is a transverse section taken along the line 4—4 of FIG. 3.
FIG. 5 is a sectional view taken along the line 5—5 of FIG. 2.

In accordance with this invention it has now been found that the adjustable legs of a wheelchair can be raised and lowered to any desired position by a device which is uniquely constructed for this purpose and which is not an integral part of the wheelchair. Rather, the device of this invention is portable, can be releasably engaged to the sides next to the left or right arm of the wheelchair and can be readily maneuvered by the invalid to raise and lower the legs to any desired convenient height without interfering with their comfort. The device of this invention is usually of unitary construction and may be made of metal or plastic and may be used on different wheelchairs. Thus, it differs from most prior art devices which are usually an integral part of the wheelchair and hence cannot be used for other wheelchairs.

Referring now to FIG. 1 of the drawings, there is shown a typical wheelchair which comprises the frame 1 and seat 3, arm rests 5, a pair of angular substantially vertical front members 7 secured to the frame 1 and extending downwardly below the seat 3. The wheelchair also includes a pair of front legs 9 having the usual foot rests 11. The legs 9 extend downwardly of the wheelchair to a point slightly above the floor at their lowest position so that each leg can be raised or lowered freely.

A pair of angular, substantially inverted L-shaped support members 13 are removably attached to the front members 7 of the wheelchair for engagement with the device of this invention. The inverted L-shaped members 13 include a substantially horizontal, forwardly end thereof adapted to receive the device of this invention as will hereinafter be explained. The legs 9 are pivoted to the members 13 by a pin 12 at the cavity 17 which acts as a fulcrum for this device.

The device of this invention is a generally L-shaped member 19 such as shown in FIG. 2. It may be formed of metal or plastic and has a first elongated portion 21 and a second elongated portion 23 angularly formed or connected to the elongated portion 21. A grip handle 25 may be welded or otherwise securely attached to the elongated portion 23 although, in its simplest construction, the second elongated portion 23 itself could serve as the handle for gripping by the invalid during its use.

The device of this invention also includes the positioning bracket 27 braced or welded to the elongated portion 21 as shown in FIGS. 2 and 3, said bracket 21 having a lip 29 adapted to be engaged into the recess or cavity 17 of the forwardly projecting portion 15 of the L-shaped member 13. The inside surface of the lip 29 may be coated with a suitable coating material (e.g., polytetrafluorethylene or an elastomeric material such as rubber) in order to protect the finish of the wheelchair. At its free end the elongated member 21 is provided with a leg support cross member 31 which may be welded or otherwise suitably secured transversely at the free end of the elongated member 21. The leg support cross member 31 is a generally flat plate member having a pair of generally vertical, upwardly extending arms 33 and 35 which serve to prevent the leg from sliding off the cross member 31 when the device is used to elevate or lower each leg to the desired height. The arms 33 and 35 are preferably integrally formed at the end of cross member 31 although they may be separately welded or otherwise suitably secured thereto.

In order to use the device of this invention to raise or lower the legs of the wheelchair, the invalid would simply grip the handle 25 and insert lip 29 of the positioning bracket 27 into the recess or cavity 17 of the L-shaped member 13. Thus, for raising the left leg, for example, the leg is supported on the left portion of the cross member 31 and the grip handle is pulled back and slightly upward in order to raise the leg to any desired convenient height. The footrest is maintained in the selected raised position by a suitable retaining mechanism which may comprise a horizontally aligned rod 37 which slides through a hole by a clutching mechanism having a control handle (not shown). The clutching mechanism grips the rod as it is inserted and releases it only upon actuation of the control handle.

In order to lower the leg, the control grip handle is released, thus causing the leg to drop to a lower height or to its initial position and the leg may be eased slowly by the invalid by pulling backward on the handle 25.

Similarly, in order to lower the right leg, the lip 29 of the positioning bracket 27 is engaged into the cavity 17 provided in the attachment 13 adjacent to the right leg, and the grip handle 25 maneuvered as hereinbefore described in order to raise the right leg to any desired height. Once raised to a given height, the right leg may be lowered by simply releasing the grip handle 25 as aforesaid.

It is evident from the foregoing description that several obvious modifications may be made in the construction of the device of this invention. For example, the elongated member 23 of the device of this invention may be a hollow member for telescopically receiving the release rod 39, thus making it possible for the invalid to lower the leg without bending out of position. Such modifications and other obvious variations are, however, within the scope and contemplation of this invention.

What is claimed is:

1. A device for elevating and lowering the legs of a wheelchair of the type equipped with adjustable legs, which device is a generally inverted L-shaped member comprising a first elongated member having a free end and a second elongated member having a free end formed angularly with said first elongated member, means secured substantially at the juncture of the first elongated member and the second elongated member for attachment to said wheelchair adjacent each leg thereof and a cross member transversely secured at the free end of said first elongated member adapted for supporting either leg of the wheelchair.

2. The device of claim 1 wherein said cross member has generally vertical, upward extending arms at each end thereof adapted to prevent the leg from sliding off said cross member.

3. The device of claim 1 wherein said means secured substantially at the juncture of said first elongated member and said second elongated member is a bracket.

4. The device of claim 2 wherein said means secured substantially at the juncture of said first elongated member and said second elongated member is a bracket.

5. The device of claim 1 wherein said second elongated member is provided with a grip handle.

6. The device of claim 2 wherein said second elongated member is provided with a grip handle.

7. The device of claim 3 wherein said second elongated member is provided with a grip handle.

8. The device of claim 4 wherein said second elongated member is provided with a grip handle.

* * * * *